US010082294B2

(12) United States Patent
Laster et al.

(10) Patent No.: US 10,082,294 B2
(45) Date of Patent: Sep. 25, 2018

(54) FUEL INJECTOR INCLUDING TANDEM VANES FOR INJECTING ALTERNATE FUELS IN A GAS TURBINE

(71) Applicant: Siemens Energy, Inc., Orlando, FL (US)

(72) Inventors: Walter Ray Laster, Oviedo, FL (US); Jacob William Hardes, Charlotte, NC (US); Robert H. Bartley, Oviedo, FL (US); Mario Gaviria, St. Cloud, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 15/540,784

(22) PCT Filed: Jan. 29, 2015

(86) PCT No.: PCT/US2015/013523
§ 371 (c)(1),
(2) Date: Jun. 29, 2017

(87) PCT Pub. No.: WO2016/122529
PCT Pub. Date: Aug. 4, 2016

(65) Prior Publication Data
US 2018/0023812 A1 Jan. 25, 2018

(51) Int. Cl.
*F23R 3/28* (2006.01)

(52) U.S. Cl.
CPC ..... *F23R 3/286* (2013.01)

(58) Field of Classification Search
CPC .... F23R 3/14; F23R 3/286; F23R 3/30; F23R 3/32; F23C 2900/07001
See application file for complete search history.

(56) References Cited

U.S. PATENT DOCUMENTS 7,703,288 B2 * 4/2010 Rogers ..... F23R 3/14 239/400
8,113,002 B2 * 2/2012 Lacy ..... F23R 3/286 60/737
8,511,087 B2 8/2013 Fox et al.
8,661,779 B2 3/2014 Laster et al.

OTHER PUBLICATIONS

PCT International Search Report and Written Opinion dated Oct. 12, 2015 corresponding to PCT Application No. PCT/US2015/013523 filed Jan. 29, 2015.

* cited by examiner

*Primary Examiner* — Arun Goyal

(57) ABSTRACT

A fuel injector for injecting fuels having a different energy density in a gas turbine is provided. A first fuel supply channel (18) and a second fuel supply channel (20) may be coaxially arranged in a fuel delivery structure (12). A first set of vanes 22 includes a radial passage (24) in fluid communication with the first channel (18) to receive a first fuel. Passage (24) branches into passages (26) each having an aperture (28) to inject the first fuel without jet in cross-flow injection. A second set of vanes (32) includes a radial passage (34) in fluid communication with the second channel (20) to receive a second fuel. Passage (34) branches into passages (36) each having an aperture (38) arranged to inject the second fuel also without jet in cross-flow injection. This arrangement may be effective to reduce flashback that otherwise may be encountered in fuels having a relatively high flame speed.

11 Claims, 3 Drawing Sheets

FUEL INJECTOR INCLUDING TANDEM VANES FOR INJECTING ALTERNATE FUELS IN A GAS TURBINE

STATEMENT REGARDING FEDERALLY SPONSORED DEVELOPMENT

Development for this invention was supported in part by Contract No.DE-FC26-05NT42644, awarded by the United States Department of Energy. Accordingly, the United States Government may have certain rights in this invention.

BACKGROUND

1. Field

Disclosed embodiments are generally related to fuel injectors for a gas turbine, and, more particularly, to fuel injectors including tandem vanes for injecting alternate fuels, such as may comprise fuels having a different energy density.

2. Description of the Related Art

Economic considerations have pushed the development of gas turbines capable of using alternate fuels, such as may involve synthetic gases (e.g., syngas) in addition to using fuels, such as natural gas and liquid fuels, e.g., oil. These synthetic gases typically result from gasification processes of solid feedstock such as coal, pet coke or biomass. These processes may result in fuels having substantially different fuel properties, such as composition, heating value and density, including relatively high hydrogen content and gas streams with a significant variation in Wobbe index (WI). The Wobbe index is generally used to compare the combustion energy output of fuels comprising different compositions. For example, if two fuels have identical Wobbe indices, under approximately identical operational conditions, such as pressure and valve settings, the energy output will be practically identical.

Use of fuels having different fuel properties can pose various challenges. For example, as the heating value of the fuel drops, a larger flow area would be required to deliver and inject the fuel into the turbine and provide the same heating value. Thus, it is known to construct different passages for the injector flow to accommodate the Wobbe index variation in the fuels. Another challenge is that fuels having a high hydrogen content can result in a relatively high flame speed compared to natural gas, and the resulting high flame speed can lead to flashback in the combustor of the turbine engine. See U.S. Pat. Nos. 8,661,779 and 8,511,087 as examples of prior art fuel injectors involving vanes using a traditional jet in cross-flow for injection of alternate fuels in a gas turbine.

DETAILED DESCRIPTION

The inventors of the present invention have recognized certain issues that can arise in the context of certain prior art fuel injectors that may involve tandem vanes for injecting alternate fuels in a gas turbine. For example, some known fuel injector designs involve tandem vanes using a jet in cross-flow injection to obtain a well-mixed fuel/air stream into the combustor of the turbine engine. However, such designs may exhibit a tendency to flashback, particularly in the context of fuels with high hydrogen content. In view of such recognition, the present inventors propose a novel fuel injector arrangement where fuel is injected without jet in cross-flow injection, such as in the direction of the air flow intake in lieu of the traditional jet in cross-flow injection.

In the following detailed description, various specific details are set forth in order to provide a thorough understanding of such embodiments. However, those skilled in the art will understand that embodiments of the present invention may be practiced without these specific details, that the present invention is not limited to the depicted embodiments, and that the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

The terms "comprising", "including", "having", and the like, as used in the present application, are intended to be synonymous unless otherwise indicated. Lastly, as used herein, the phrases "configured to" or "arranged to" embrace the concept that the feature preceding the phrases "configured to" or "arranged to" is intentionally and specifically designed or made to act or function in a specific way and should not be construed to mean that the feature just has a capability or suitability to act or function in the specified way, unless so indicated.

Figure 1:
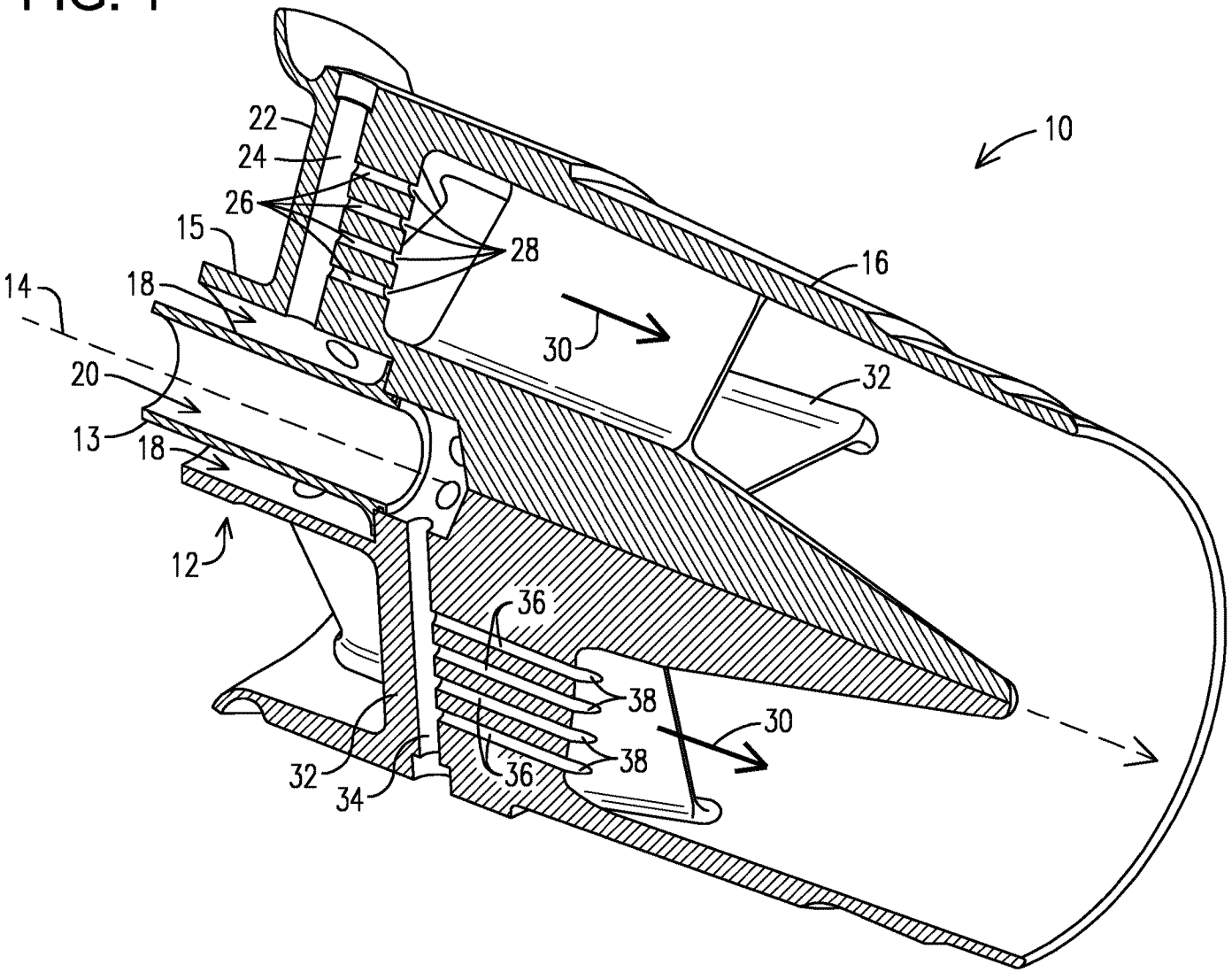
FIG. 1 is an isometric view of one non-limiting embodiment of a fuel injector embodying aspects of the invention, as may be used in a gas turbine capable of using alternate fuels.

FIG. 1 is an isometric view of one non-limiting embodiment of a fuel injector 10 embodying aspects of the invention, as may be used in a gas turbine capable of using alternate fuels. A fuel delivery tube structure 12 is disposed along a central axis 14 of fuel injector 10. Fuel delivery tube structure 12 may be surrounded by a shroud 16. A first fuel supply channel 18 and a second fuel supply channel 20 may be coaxially arranged in fuel delivery tube structure 12.

In one non-limiting embodiment, fuel delivery tube structure 12 may comprise coaxially disposed inner 13 and outer tubes 15, where inner tube 13 comprises the second fuel supply channel 20, and where the first fuel supply channel 18 is annularly disposed between inner and outer tubes 13, 15.

Figure 2:
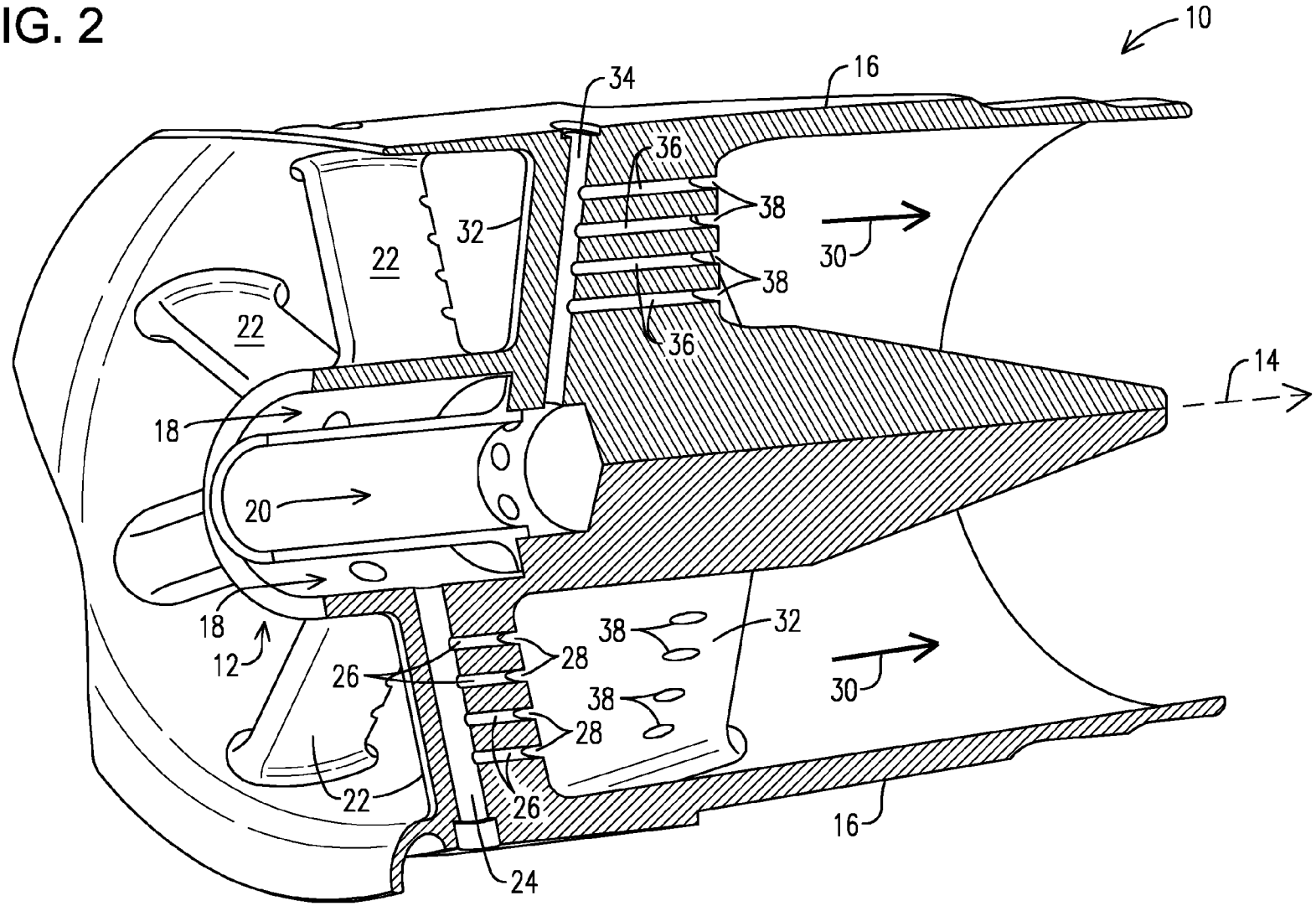
FIG. 2 is a rearwardly isometric view of the fuel injector shown in FIG. 1.

As can be also appreciated in FIG. 2, a first set of vanes 22 may be circumferentially disposed about fuel delivery tube structure 12, such as arranged between fuel delivery tube structure 12 and shroud 16. A radial passage 24 may be constructed in each vane 22. For simplicity of illustration, radial passage 24 is illustrated just in one of the vanes 22. Radial passage 24 is in fluid communication with first fuel supply channel 18 to receive a first fuel. In one non-limiting embodiment, radial passage 24 may be configured to branch into a set of passages 26 (e.g., axial passages) each having an aperture 28 arranged to inject the first fuel not in a jet in cross-flow mode, such as in a direction of air flow, schematically represented by arrows 30.

A second set of vanes 32 may be disposed downstream relative to the first set of vanes 22. The second set of vanes 32 may also be arranged between fuel delivery tube structure 12 and shroud 16. That is, the first and second set of vanes 22, 32 may be conceptualized as a tandem arrangement of vanes. A radial passage 34 may be constructed in each vane 32. Once again, for simplicity of illustration, radial passage 34 is illustrated just in one of the vanes 32. In this case, radial passage 34 is in fluid communication with second fuel supply channel 20 to receive a second fuel. In one non-limiting embodiment, radial passage 34 may be configured to branch into a set of passages 36 (e.g., axial passages) each having an aperture 38 arranged to inject the second fuel not in a jet in cross-flow mode, such as in the direction of air flow. The first fuel and the second fuel may comprise alternate fuels having a different energy density. For example, without limitation, the first fuel that flows in first fuel supply channel 18 may comprise syngas, and the second fuel that flows in second fuel supply channel 20 may comprise natural gas.

Figure 3:
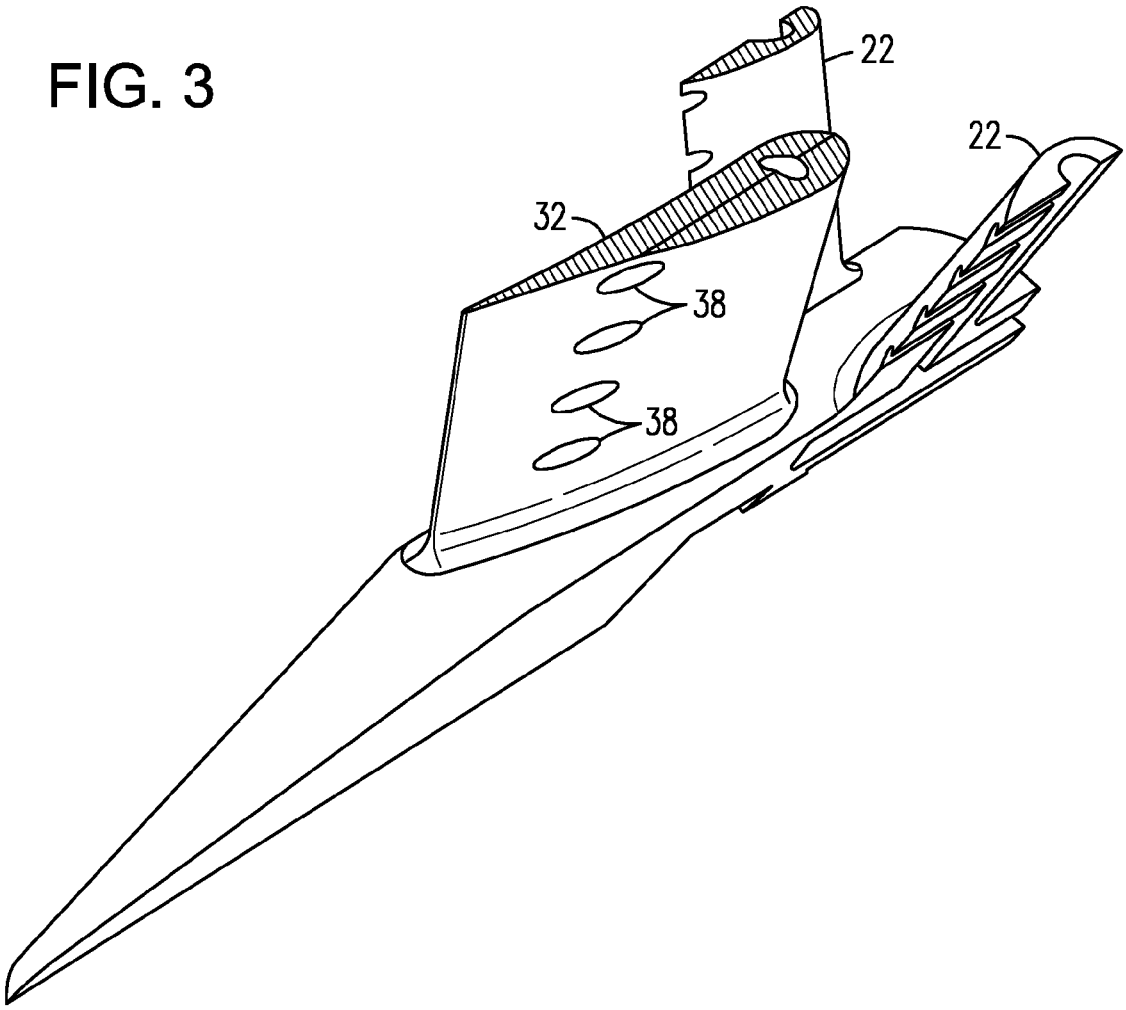
FIG. 3 is a cutaway isometric view illustrating a non-limiting embodiment arrangement of tandem vanes as may be used in a fuel injector embodying aspects of the present invention.

The foregoing arrangement (without jet in cross-flow injection) is believed to substantially reduce flashback tendencies generally encountered in the context of fuels with high hydrogen content. As may be appreciated in FIG. 3, in one non-limiting embodiment, the second set of vanes 32 may comprise swirling vanes, such as may include a respective twist angle, which in one non-limiting embodiment may comprise up to approximately 20 degrees at the tip of the vane. By way of comparison, the vanes in the first set of vanes 22 may comprise non-swirling vanes. As may be further appreciated in FIG. 3, the second set of vanes 32 is circumferentially staggered relative to the first set of vanes 22 so that none of the vanes in the second set of vanes 32 is directly behind a respective vane in the first set of vanes 22.

Figure 4:
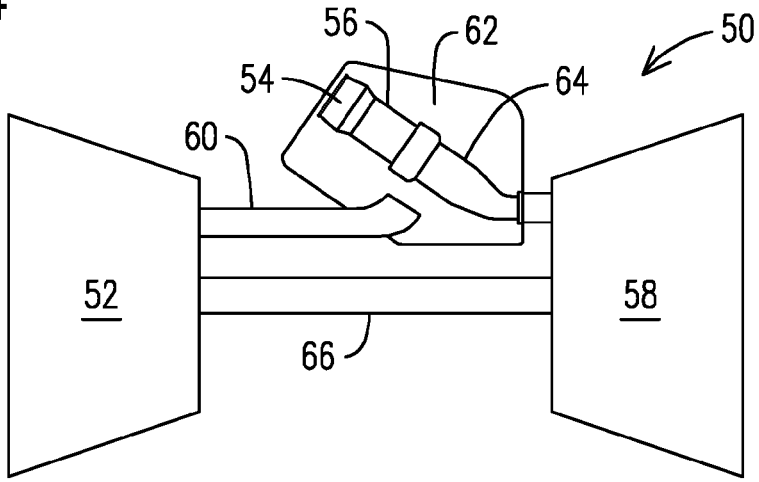
FIG. 4 is a simplified schematic of one non-limiting embodiment of a combustion turbine engine, such as a gas turbine engine, that can benefit from disclosed embodiments of the present invention.

FIG. 4 is a simplified schematic of one non-limiting embodiment of a combustion turbine engine 50, such as gas turbine engine, that can benefit from disclosed embodiments of the present invention. Combustion turbine engine 50 may comprise a compressor 52, a combustor 54, a combustion chamber 56, and a turbine 58. During operation, compressor 52 takes in ambient air and provides compressed air to a diffuser 60, which passes the compressed air to a plenum 62 through which the compressed air passes to combustor 54, which mixes the compressed air with fuel, and provides combusted, hot working gas via a transition 64 to turbine 58, which can drive power-generating equipment (not shown) to generate electricity. A shaft 66 is shown connecting turbine 58 to drive compressor 52. Disclosed embodiments of a fuel injector embodying aspects of the present invention may be incorporated in each combustor (e.g., combustor 54) of the gas turbine engine to advantageously achieve reliable and cost-effective fuel injection of alternate fuels having a different energy density. In operation and without limitation, the disclosed fuel injector arrangement is expected to inhibit flashback tendencies that otherwise could develop in the context of fuels with high hydrogen content.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A fuel injector for a gas turbine, comprising:

a fuel delivery tube structure disposed along a central axis of the fuel injector; a first fuel supply channel and a second fuel supply channel coaxially arranged in the fuel delivery tube structure;

a first set of vanes comprising a first radial passage in each vane of the first set of vanes, the first radial passage in fluid communication with the first fuel supply channel to receive a first fuel, wherein the first radial passage is configured to branch into a first set of axial passages each having a first aperture arranged to inject the first fuel in a direction of air flow; and a second set of vanes comprising a second radial passage in each of the second set of vanes, the second radial passage in fluid communication with the second fuel supply channel to receive a second fuel, wherein the second radial passage in the second set of vanes is configured to branch into a second set of axial passages each having a second aperture arranged to inject the second fuel in the direction of air flow, wherein the first fuel and the second fuel comprise fuels having a different energy density, wherein the second set of vanes is disposed downstream relative to the first set of vanes, wherein each of the second set of vanes comprise a swirling vane having a twist angle, and wherein each of the first set of vanes comprise a non-swirling vane.

2. The fue1 injector of claim 1, wherein the second set of vanes is circumferentially staggered relative to the first set of vanes so that none of the second set of vanes is directly behind any of the first set of vanes.

3. The fuel injector of claim 1, wherein the twist angle comprises up to approximately 20 degrees.

4. The fuel injector of claim 1, wherein the fuel delivery tube structure comprises coaxially disposed an inner tube and an outer tube, wherein the inner tube comprises the second fuel supply channel, and wherein the first fuel supply channel is annularly disposed between the inner tube and the outer tube.

5. The fuel injector of claim 1, wherein the fuel delivery tube structure is surrounded by a shroud, and wherein the first set of vanes and the second set of vanes is respectively arranged between the fuel delivery tube structure and the shroud.

6. The gas turbine comprising the fuel injector of claim 1.

7. A fuel injector for a gas turbine, comprising:

a fuel delivery tube structure disposed along a central axis of the fuel injector;

a first fuel supply channel and a second fuel supply channel coaxially arranged in the fuel delivery tube structure;

a first set of vanes comprising a first radial passage in each vane of the first set of vanes, the first radial passage in fluid communication with the first fuel supply channel to receive a first fuel, wherein the first radial passage is configured to branch into a first set of passages each having a first aperture arranged to inject the first fuel without a jet in cross-flow; and a second set of vanes comprising a second radial passage in each of the second set of vanes, the second radial passage in fluid communication with the second fuel supply channel to receive a second fuel, wherein the second radial passage in the second set of vanes is configured to branch into a second set of passages each having a second aperture arranged to inject the second fuel without a jet in cross-flow, wherein the first fuel and the second fuel comprise fuels having a different energy density, wherein the second set of vanes is disposed downstream relative to the first set of vanes, wherein the second set of vanes is circumferentially staggered relative to the first set of vanes so that none of the second set of vanes is directly behind any of the first set of vanes, and wherein each of the first set of vanes comprise non-swirling vane.

8. The fuel injector of claim 7, wherein the first set of passages comprise the first set of axial passages each having the first aperture arranged to inject the first fuel in a direction of air flow.

9. The fuel injector of claim 8, wherein the second set of passages comprise the second set of axial passages each having the second aperture arranged to inject the second fuel in the direction of air flow.

10. The fuel injector of claim 7, wherein each of the second set of vanes comprise a swirling vane having a twist angle.

11. The fuel injector of claim 10, wherein the twist angle comprises up to approximately 20 degrees.

* * * * *